US005438718A

United States Patent [19]

Kelly et al.

[11] Patent Number: 5,438,718

[45] Date of Patent: Aug. 8, 1995

[54] SPRING UNITS FOR MATTRESSES AND THE LIKE

[75] Inventors: Bernard J. Kelly, Lancashire, Great Britain; Antonio B. Cabeza, Madrid, Spain

[73] Assignee: Slumberland Holdings Limited, Chadderton, England

[21] Appl. No.: 65,225

[22] Filed: May 24, 1993

Related U.S. Application Data

[62] Division of Ser. No. 695,853, Apr. 5, 1991, abandoned.

[30] Foreign Application Priority Data

Aug. 5, 1988 [ES] Spain ..... 8802464
Aug. 6, 1988 [GB] United Kingdom ..... 8818725

[51] Int. Cl.[6] ..... A47C 27/04; A47C 27/20

[52] U.S. Cl. ..... 5/477; 5/475; 29/91.1

[58] Field of Search ..... 5/477, 475, 476; 267/166, 166.1, 103, 104, 105, 180; 29/91.1

[56] References Cited

U.S. PATENT DOCUMENTS

| | | | |
|---|---|---|---|
| Re. 18,976 | 10/1933 | Jones | 5/477 |
| 1,406,051 | 2/1922 | Marcus et al. . | |
| 1,749,117 | 3/1930 | Weichsel | 267/166 X |
| 1,918,189 | 10/1930 | Mayhew et al. | 267/166 X |
| 2,862,214 | 12/1958 | Thompson et al. | 5/477 |
| 3,082,428 | 3/1963 | Nachman, Jr. . | |
| 3,449,199 | 6/1969 | Mead | 267/166 X |
| 3,579,774 | 5/1971 | Shreve | 29/91.1 |
| 3,668,816 | 6/1972 | Thompson | 29/91.1 X |
| 3,869,739 | 3/1975 | Klein | 5/477 |
| 4,003,113 | 1/1977 | Bulloch, Jr. | 29/91.1 |
| 4,608,740 | 9/1986 | Blogs et al. | 29/91.5 X |

FOREIGN PATENT DOCUMENTS

| | | | |
|---|---|---|---|
| 703642 | 2/1968 | Belgium . | |
| 2521121 | 8/1983 | France | 29/91.1 |
| 2700830 | 7/1978 | Germany | 29/91.5 |
| 2856599 | 7/1980 | Germany | 29/91.5 |
| 8202254 | 1/1984 | Netherlands | 29/91.5 |
| 657588 | 9/1951 | United Kingdom . | |

*Primary Examiner*—Alexander Grosz
*Attorney, Agent, or Firm*—Burns, Doane, Swecker & Mathis

[57] ABSTRACT

A spring unit for a spring upholstered article such as a mattress or furniture includes a single length of wire defining a single length spring. The single length spring includes a plurality of adjacent coil springs which each have upper and lower coils with each coil spring being joined to adjacent coil springs by wire links which constitute extensions of at least one of the upper and lower coils. The single length spring is sheathed within a sleeve or envelope of cloth to define a sheathed single length spring. The sheathed single length spring is arranged to define adjacent segments of sheathed coil springs in which longitudinal axes of the coil springs in the adjacent segments are substantially parallel to one another. In addition, the upper coils of the coil springs in adjacent segments lye in a substantially common plane and the lower coils of the coil springs in adjacent segments lye in a substantially common plane.

9 Claims, 3 Drawing Sheets

SPRING UNITS FOR MATTRESSES AND THE LIKE

This application is a divisional of application Ser. No. 07/695,853, filed Apr. 5, 1991, now abandoned, which is a continuation of International Application No. PCT/GB89/00889, having an international filing date of Aug. 3, 1989 which designated the United States.

The present invention relates to spring units for use in mattresses, spring upholstered furniture and the like, and to a method for fabricating said spring units. The present invention also relates to a spring interior comprised of a plurality of said spring units. The present invention further relates to an article of spring upholstered furniture comprised of one or more of said spring interiors.

One well known type of spring interior is comprised of a plurality of discrete coil springs, each of which is sewn into a respective one of a plurality of elongate pockets formed in a length of calico or similar purpose material. The axes of the springs lie generally parallel with one another such that a band of springs is formed, with the upper and lower coils of the springs defining the upper and lower faces of the band. A spring interior can be fabricated from the band of springs in either one of two ways. Firstly, a plurality of bands of springs may be disposed side by side and adjacent rows clipped, stitched, glued or otherwise joined together to form a spring interior of the desired size. Alternatively, a single band of springs may be folded back and forth on itself to form a zigzag pattern of rows, whereupon adjacent rows are, again, joined together.

This type of spring interior is commonly referred to as a pocketed spring interior owing to the fact that each spring is contained within a respective pocket of calico material. It is generally acknowledged that pocketed spring interiors have a unique and particular luxurious feel to them, and mattresses comprised of pocketed spring interiors are said to have a feeling of softness about them, without lacking spring resilience. However one describes the feel of a pocketed spring interior it is certainly the case that they command a high price. This can be attributed to the considerable amount of time and labour which is involved in their manufacture, together with the fact that the method of fabrication and assembly of pocketed spring interiors does not readily lend itself to automation; each spring is individually stitched into its own pocket and bands of springs are then arranged in rows to be joined together.

As well as being comparatively expensive pocketed spring interiors have certain inherent disadvantages associated with them. To accommodate the load on each spring the springs may need to be made of relatively heavy gauge spring wire. In addition, because the springs are completed unsupported, except by the pocket of material in which each is contained, they suffer from instability and a tendency to become dislocated. This problem can be minimised by keeping the springs very close together, but this leads to one spring interfering with its immediate neighbours, and because a higher spring count is necessary further adds to the high cost of pocketed spring interiors.

Another well known type of spring interior comprises a plurality of bands of continuous coil springs disposed side by side and interconnected by a plurality of helical wires, bands, rings or the like. Each band of continuous coil springs comprises a single length of wire in which a plurality of individual coil springs is formed. Each spring is wound in the opposite direction to the springs immediately adjacent to it in the band and is joined thereto by wire links which are formed by straight extensions of the upper and lower coil of each spring. Each coil spring is coupled with the next by having an intermediate coil thereof interlaced with the corresponding coil of the adjacent spring. When bands of continuous coil springs are assembled together to form a spring interior they are disposed side by side with the longitudinal axes of the springs generally parallel with one another and the upper and lower coils of each spring in an upper and lower plane, respectively.

Although this type of spring interior does not suffer from "cupping" to the same extent as a pocketed spring interior and provides good overall support, it lacks the flexibility and soft, yet resilient feel of a pocketed spring interior. This can be attributed to the interconnected mesh of springs which comprise the spring interior. As will be readily appreciated the continuous coil springs are not only joined together along each row, but are also interlinked between adjacent rows. This reduces the ability of each spring to act independently when supporting a load and, instead, there is a tendency for the springs to be pulled towards the point of heaviest loading.

It is an object of the present invention to provide a novel spring unit.

It is another object of the present invention to provide a method of fabricating these spring units.

It is yet another object of the present invention to provide a spring interior comprising one or more of these spring units which obviates or substantially mitigates the problems and disadvantages associated with the conventional spring interiors referred to hereinabove, whilst retaining their advantages.

It is still another object of the present invention to provide an article of spring upholstered furniture comprised of one or more of these spring interiors.

According to a first aspect of the present invention there is provided a spring unit comprising a continuous coil spring, as hereinafter defined, sheathed within a sleeve or envelop of cloth or cloth like material, characterized in that the sleeve or envelope is formed by wrapping one or more sheets of material around the continuous coil spring and joining together the edges thereof.

The term "continuous coil spring" is understood to mean a plurality of coil springs connected in series to form a band or continuous length of coil springs. The coil springs in each band are conveniently fabricated from a single length of wire and each spring is connected to its immediate neighbour by a wire link form by an extension of upper or lower coil thereof. To facilitate fabrication each spring is wound in the opposite direction to its immediate neighbour in the band, though the springs can all be wound in the same direction if so required. As an alternative to fabricating each band of coil springs from a single length of wire, each coil spring may be formed separately and connected to its immediate neighbour in the band by rings, bands, wire links or the like.

The sleeve of material may be comprised of virtually any strong yet flexible material, though for preference it is comprised of calico. The sleeve of material may be loosely fitting or an exact fit or it can be so tight as to partially compress the springs. To this end the sleeve of material may be either inelastic or elastic as required.

According to a second aspect of the present invention there is provided a method of fabricating a spring unit comprising a continuous coil spring, as hereinbefore described, sheathed within a sleeve or envelope of cloth or cloth like material, characterized in that the sleeve or envelope is carried on a tubular former though which the continuous coil spring is drawn thereby entraining the sleeve or envelope and drawing the sleeve or envelope off the tubular former around the continuous coil spring. In order to facilitate entry of the continuous coil spring into the sleeve or envelope the springs comprising the continuous coil spring may be partially compressed by the tubular former.

According to a third aspect of the present invention there is provided a method of fabricating a spring unit comprising a continuous coil spring, as hereinbefore described, sheathed within a sleeve or envelope of cloth or cloth like material characterized in that one or more sheets of cloth or cloth like material, and the continuous coil spring are fed together through a former device which directs the edges of the sheet or sheets together, around the continuous coil spring, and the edges of the sheet or sheets are then joined together. The edges of the sheet or sheets may be joined by stitching, gluing, heat welding or the like to complete the sleeve.

According to a fourth aspect of the present invention there is provided a method of fabricating a spring unit comprising a continuous coil spring, as hereinbefore described, sheathed within a sleeve or envelope of cloth or cloth like material characterized in that the continuous coil spring is sandwiched between two sheets of cloth or cloth like material, the edges of which are then joined together to complete the sleeve of material around the continuous coil spring.

According to a fifth aspect of the present invention there is provided a spring interior comprising one or more spring units in accordance with the first aspect of the present invention, the or each spring unit being so arranged that the longitudinal axes of the springs are generally parallel with one another and the upper and lower coils of each spring lie, respectively, in an upper and lower plane.

In one embodiment the spring interior comprises at least one spring unit which is folded at intervals along its length such that a generally zig-zag shaped configuration is defined. In a further embodiment the spring interior comprises at least one spring unit which is wound round on itself in a spiral.

In yet another embodiment the spring interior comprises a plurality of spring units which are disposed side by side.

Preferably, adjacent sections of spring unit are connected or joined together. In this respect, the coil springs from the adjacent sections of spring unit may be linked together and/or the sleeves of material may be joined together. The coil springs may be joined together by means of, for example, hog rings and/or stitches which pass through the sleeves of material. The sleeves may be joined together by, for example, welding, stitching or gluing. Other linking means and/or joining techniques may also be employed as will be readily apparent to those skilled in the art.

Preferably, the spring interior further comprises an additional length of spring unit in accordance with the first aspect of the present invention which extends around the perimeter of the or the plurality of spring units thereby defining a border therearound.

Preferably, the spring interior is secured to and supported by a peripheral frame. This peripheral frame may comprise a pair of steel bands or wires each of which encircles the spring units comprising the spring interior and lies in the same plane as a respective main face of the spring interior.

Owing to the unique construction of the spring interior of the present invention its performance cannot be directly compared with either conventional pocketed spring interiors or conventional continuous coil spring interiors. Nevertheless, it has been found to have a feel approaching that of a conventional pocketed spring interior, whilst retaining the benefits of a conventional continuous coil spring interior.

By enclosing each length of continuous coil spring in its own sleeve and isolating it from adjacent lengths of continuous coil spring the coils in each length of continuous coil spring are allowed to move independently of those in the adjacent lengths of continuous coil spring. This at least mitigates the tendency of conventional continuous coil spring interiors to pull the spring matrix towards the point of heaviest load. It also results in very much less noise from the coils as they move relative to one another under load as compared with conventional continuous coil spring interiors.

The large number of springs per unit area which is made possible by the use of continuous coil springs allows light gauge wire to be used which is relatively easy to work. Additionally, the use of continuous coil springs, each enclosed within its own sleeve, makes assembly of the spring interior a relatively simple matter which is readily suited to automation. Further, the link wire between adjacent coils in each length of continuous coil spring provides an additional torsion spring and helps to prevent "cupping" from occurring.

According to a third aspect of the present invention there is provided an article of upholstered furniture comprising one or more spring interiors according to the second aspect of the present invention. Though by no means an exhaustive list the term "article of upholstered furniture" may be taken to include mattresses for beds, spring upholstered cushions, whether formed separately or as an integral part of the article of upholstered furniture, seat squabs, back rests, arm rests, head rests, headboards for beds and the like.

An embodiment of the present invention will now be described, by way of example, with reference to the accompanying drawings, in which.

Figure 6:
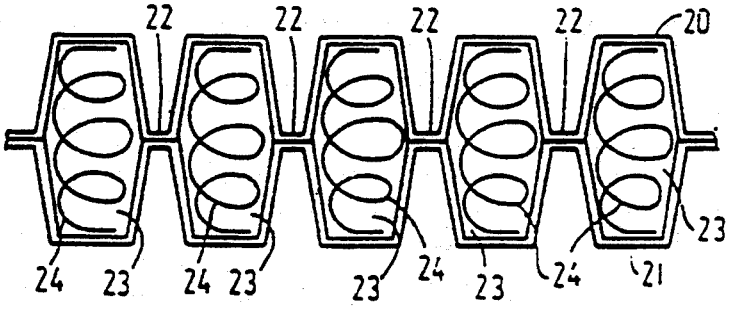
FIG. 6 shows a section through a spring interior embodying the second aspect of the present invention and employing a plurality of integrally formed sleeves.
Figure 7:
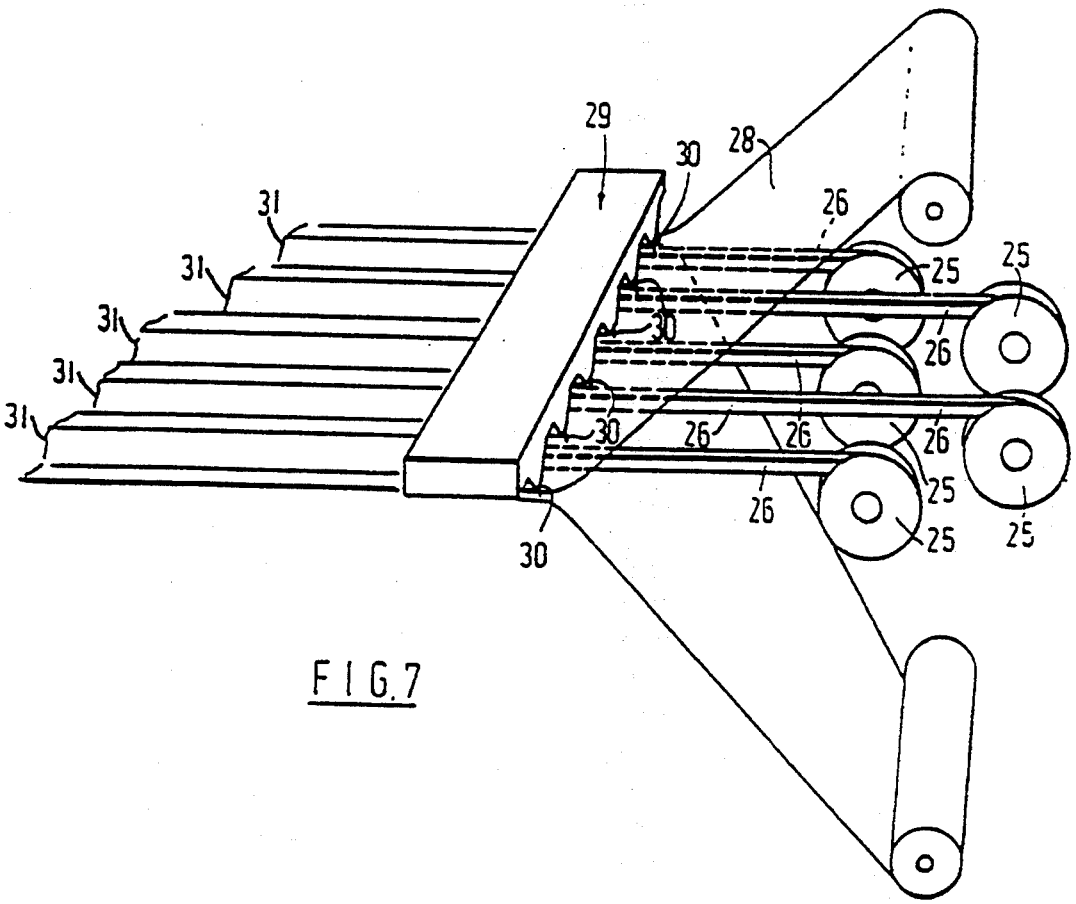
Figure 8:
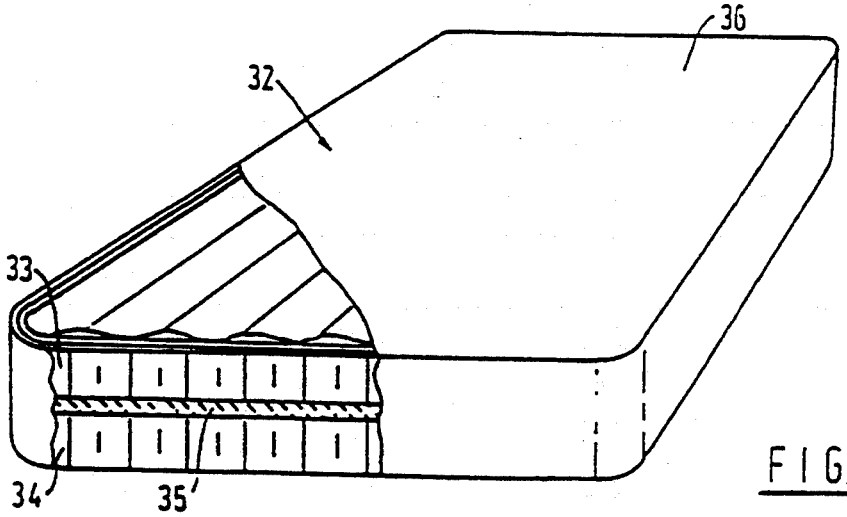

FIG. 7 shows a schematic view of an apparatus for simultaneously enveloping each of a plurality of lengths of continuous coil spring in a respective sleeve and producing a spring interior as shown in FIG. 6; and FIG. 8 shows a diagramatic view of a mattress comprising a pair of spring interiors according to the second aspect of the present invention in which the exterior upholstery has been partially cut away.

Figure 1:
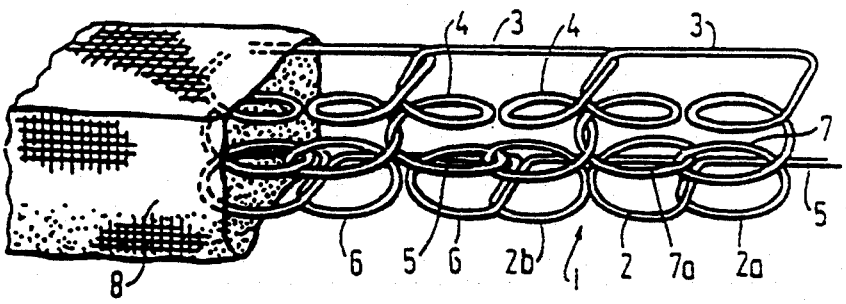
FIG. 1 shows a perspective view of a spring unit according to the first aspect of the present invention.

Referring to FIG. 1 of the accompanying drawings there is shown a spring unit embodying the present invention comprising a single band of continuous coil springs 1 which is formed from a length of spring wire shaped to form a plurality of individual coil springs 2. Each spring 2 is wound in the opposite direction to its two immediate neighbours in the band and is joined to one adjacent spring 2*a* by a wire link 3 which forms an integral extension of the upper coils 4 of the two springs 2, 2*a* and to the other adjacent spring 2*b* by a wire link 5 which forms an integral extension of the lower coils 6 of the two springs 2, 2*b*. Each spring 2 is coupled to the spring 2 adjacent to it by having one intermediate coil 7 thereof interlaced with the corresponding intermediate coil 7*a* of the next spring.

The continuous coil spring described hereinabove is of conventional construction, but it should be understood that the spring unit according to the present invention is not intended to be limited to this particular configuration and can comprise continuous coil springs of any configuration. For example, successive coil springs in a band need not be wound in the opposite direction, but can all be wound in the same direction if so required. Furthermore, each coil spring can be formed separately and connected to its immediate neighbour in the band by rings, bands, wire links or the like.

The band of continuous coil springs 1 is enveloped or sheathed within a sleeve of calico material 8 which is closed at both ends to complete the spring unit according to the present invention. The sleeve of material may be loosely fitting or an exact fit or it can be so tight as to lightly compress the springs. To this end the sleeve of material may be either in-elastic or elastic as required. One or a plurality of spring units embodying the present invention can be assembled to form a spring interior as will be described later hereinbelow.

Two methods of enveloping the continuous coil spring 1 in the sleeve of calico material 8 will now be described:

In a first such method, which is illustrated with reference to FIG. 2 of the accompanying drawings, a separately formed sleeve of calico material 8 is carried on a tubular former 9 and the band of continuous coil spring 1 is wound onto a reel 10. The free end of the band 1 is drawn off the reel 10, through one end of the tubular former 9 and out the other end. As the band 1 passes through the tubular former 9 it draws off the sleeve of calico material from the tubular former 9 and entrains it around itself. Although not shown the free end of the enveloped band of continuous coil spring may be wound onto a second reel for use later. Once enough of the band 1 has been covered with the calico sleeve 8, both are cut and the open ends of the calico sleeve 8 stitched together.

In an alternative method, illustrated with reference to FIG. 3 of the accompanying drawings, a continuous sheet of calico material 11 is carried on a reel 12 and the band I is wound on a reel 10. The free ends of the calico material 11 and of the band 1 are drawn through a V-shaped former 13 which serves to direct the sides of the sheet 11 up and around the band 1. Above the V-shaped former 13 is a stitching machine 14 which simultaneously draws the sides of the calico material 11 together and stitches them together. Thus, the band 1 is covered in a sleeve of calico material 8.

As with the method of manufacture described with reference to FIG. 2, once the required length of band 1 has been covered with the calico sleeve 8, the band 1 may be cut to length and the open ends of the sleeve 8 stitched together.

Figure 2:
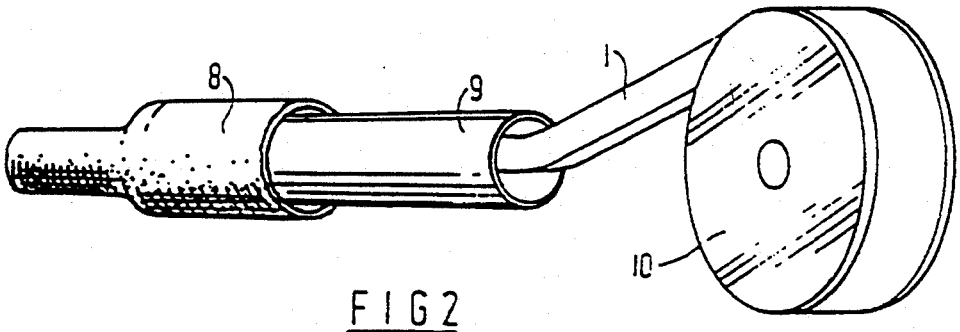
FIG. 2 shows a schematic view of a first apparatus for enveloping a band of coil springs in a cloth sleeve.
Figure 3:
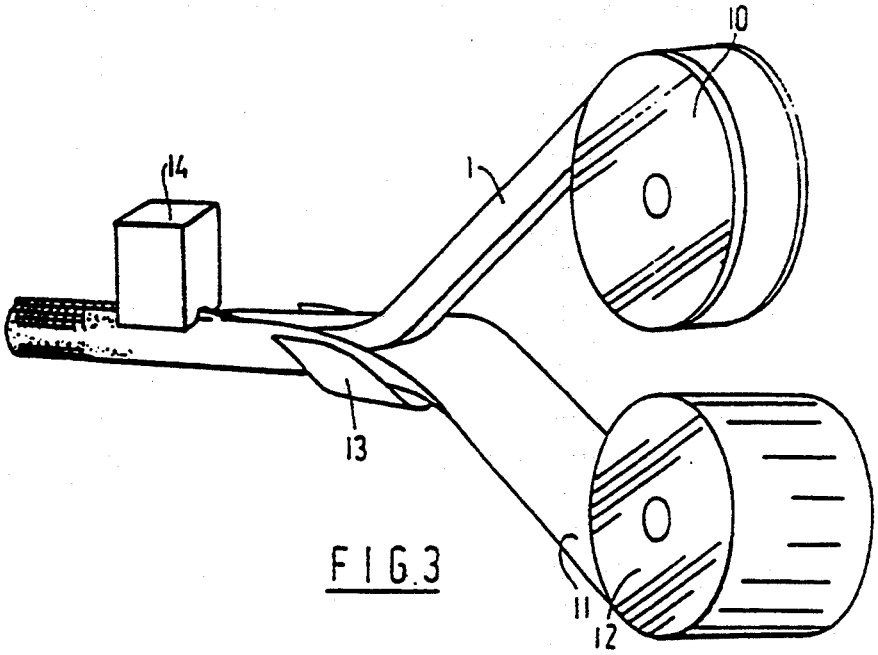
FIG. 3 shows a schematic view of a second apparatus for enveloping a band of coil springs in a cloth sleeve.

Although the techniques illustrated witch reference to FIGS. 2 and 3 both show the band 1 being drawn from a reel 10, it will be appreciated that both techniques may also be applied to the band 1 as it comes off the coil forming and coil interlacing equipment.

Figure 4:
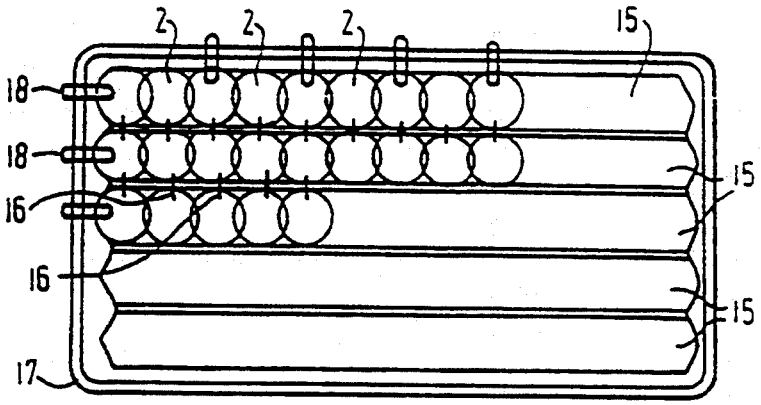
FIG. 4 shows a diagrammatic plan view of a first spring interior embodying the second aspect of the present invention.

Referring now to FIG. 4 of the accompanying drawings there is shown a diagramatic plan view of a spring interior embodying the second aspect of the present invention in which a plurality of discrete lengths of the spring unit 15 described with reference to FIG. 1 are disposed side by side. Adjacent lengths 15 are connected together by hog rings 16, each of which serves to connect a spring 2 from one length 15 to the neighbouring spring 2 in the adjacent length 15. Around the perimeter of the spring interior, opposite the upper and lower main faces thereof, there is provided a peripheral frame 17 which provides support for, and rigidity to, the edges of the spring interior. Each frame 17 is connected to the spring interior by means of short strips of metal 18 each of which is connected between the frame 17 and an adjacent spring 2 of the spring interior.

As will be readily appreciated from FIG. 4 the spring interior is, in the conventional sense, neither a continuous coil spring interior, nor a pocketed coil spring interior. However, it retains features of both types. Specifically, the independent movement allowed between the coil springs 2 in adjacent lengths 15 of the spring unit according to the first aspect of the present invention avoids the tendency of conventional continuous coil spring interiors to pull the spring matrix towards the point of heaviest load. This ensures much more uniform and even support for the load and results in greater comfort for a person resting on the spring interior. Moreoever, because each length of continuous coil spring is isolated from its neighbour by the sleeve of calico material there is much less spring noise as the springs 2 in adjacent lengths move relative to one another.

The spring interior of the present invention still makes use of continuous coil springs, and as such manufacture of the spring interior is very much quicker, simpler and less costly than with conventional pocketed coil spring interior where each coil must be separately secured into its own pocket in the spring interior. Additionally, the large number of coil springs per unit area in a continuous coil spring interior means that the gauge of spring wire used can be reduced without significantly affecting the performance of the spring interior.

Figure 5:
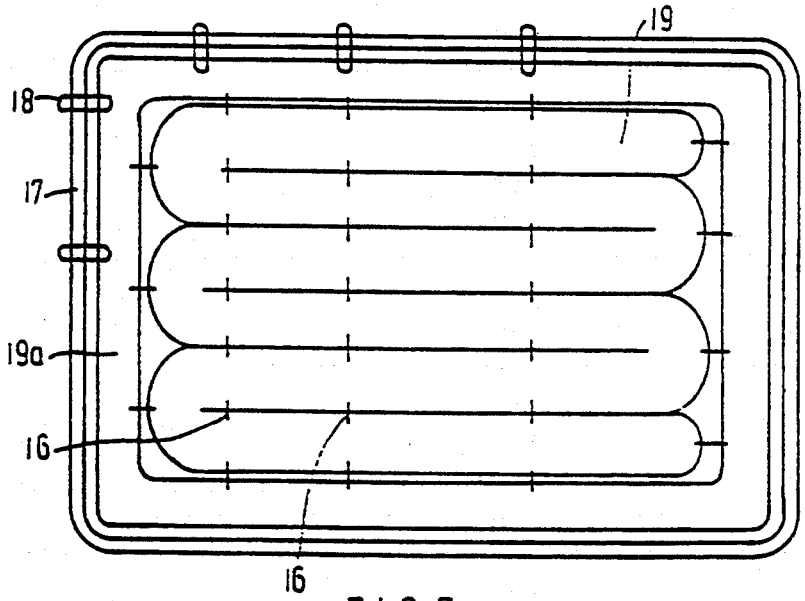
FIG. 5 shows a diagramatic plan view of a second spring interior embodying the second aspect of the present invention.

Referring now to FIG. 5 there is shown a diagramatic plan view of an alternative spring interior embodying the second aspect of the present invention. In this embodiment a single length 19 of the spring unit described with reference to FIG. 1 is folded back and forth on itself several times to form a plurality of rows disposed side by side. As in the previous embodiment of FIG. 4 adjacent rows are connected together by means of hog clips 16. A further length 19*a* of the spring unit described with reference to FIG. 1 is wrapped around the perimeter of the spring interior to finish the edge off. As in the spring interior described with reference to FIG. 4 a peripheral frame 17 is provided opposite the top and bottom main faces of the spring interior to provide support for and rigidity to the edges of the spring interior.

Referring now to FIG. 6 of the accompanying drawings there is shown yet another spring interior embodying the second aspect of the present invention in which two facing sheets 20 and 21 of calico material are stitched together at spaced intervals 22 along their width. The stitching extends the full length of the sheets 20 and 21, and as such defines a plurality of elongate sleeves 23. Within each sleeve 23 there is contained a discrete length of continuous coil spring 24. To complete the spring interior the open ends of the sleeve 23 are stitched together.

It will be understood that the two sheets of material may be stitched together with the continuous coil springs 24 in-situ therebetween using, for example, a multi-needle quilting machine or multi-head sewing machine, as shown in FIG. 7. With reference to FIG. 7 there is shown a plurality of reels 25, each of which carries a band of continuous coil spring 26. Above and below the reels 25 there is provided a roll 26, 27 of calico material 28, the width of each of which is slightly greater than that of the spring interior to be produced. Positioned in front of the reels 25 and the rolls 26 is a multi-head sewing-machine 29 comprising a plurality of sewing heads 30.

In use, the bands of continuous coil spring 26 are drawn from the reels 25 and are sandwiched between the calico material 28 drawn from the upper and lower rolls 26, 27. This sandwich of material 28 and bands 26 is then drawn through the multi-head sewing machine 29 which is so configured that a sewing head 30 passes along each side of the bands 26 and stitches together the upper and lower sheets of calico material 28. Thus, each band 26 is enclosed within a respective sheath 31 of calico material 28. After production the resultant spring interior can be cut to size and the open ends of the sheaths 31 stitched together.

As an alternative to the above method of manufacture, the two sheets 20 and 21 may be stitched together separately and the continuous coil springs 24 introduced into the sleeves 23 in a separate operation using, for example, a plurality of tubular formers to support each sleeve whilst a length of continuous coil spring 24 is introduced therein as described hereinabove with reference to FIG. 2.

Referring now to FIG. 7 of the accompanying drawings there is shown a mattress 32 comprising two spring interiors 33, 34 embodying the present invention which are separated from each other by a layer of wool padding material 35 and covered with a suitable covering material 36.

We claim:

1. A spring unit for a spring upholstered article such as a mattress or furniture, comprising: a single length of wire defining a single length spring, said single length spring including a plurality of adjacent coil springs which each have upper and lower coils, each coil spring being joined to adjacent coil springs by wire links which constitute extensions of at least one of the upper and lower coils, said single length spring being sheathed within a sleeve or envelope of cloth to define a sheathed single length spring, said sheathed single length spring being arranged to define adjacent rows of sheathed coil springs in which longitudinal axes of the coil springs in the adjacent rows are substantially parallel to one another, the upper coils of the coil springs in adjacent rows lying in a substantially common plane and the lower coils of the coil springs in adjacent rows lying in a substantially common plane.

2. The spring unit according to claim 1, wherein the sheathed single length spring is folded back and forth upon itself to define the adjacent rows of sheathed coil springs.

3. The spring unit according to claim 1, including means for joining adjacent rows of sheathed coil springs to one another.

4. The spring unit according to claim 1, wherein said sheathed single length spring defines a first sheathed single length spring, and including an additional sheathed single length spring which is joined to and extends around a perimeter of the first sheathed single length spring.

5. An article of furniture comprising at least one spring unit that includes a single length of wire defining a single length spring, said single length spring being formed as a plurality of adjacent coil springs which each have upper and lower coils, each coil spring being joined to adjacent coil springs by wire links which constitute extensions of at least one of the upper and lower coils, said spring unit also including a sleeve or envelope of cloth in which the single length spring is sheathed, said spring unit being arranged to define adjacent rows of sheathed coil springs in which longitudinal axes of the coil springs in adjacent rows are substantially parallel to one another, the upper coils of the coil springs in adjacent rows lying in a substantially common plane and the lower coils of the coil springs in adjacent rows lying in a substantially common plane.

6. The article of furniture according to claim 5, wherein the spring unit is folded back and forth upon itself to define the adjacent rows of sheathed coil springs.

7. The article of furniture according to claim 5, including means for joining adjacent rows of sheathed coil springs to one another.

8. The article of furniture according to claim 7, wherein said spring unit defines a first spring unit, and including another spring unit which is joined to and extends around a perimeter of the first spring unit.

9. An article of furniture comprising a first spring unit that includes a single length of wire defining a single length spring, said single length spring being formed as a plurality of adjacent coil springs which each have upper and lower coils, each coil spring being joined to adjacent coil springs by wire links which constitute extensions of at least one of the upper and lower coils, said first spring unit also including a sleeve or envelope of cloth in which the single length spring is sheathed, said first spring unit being folded back and forth upon itself to form adjacent segments of sheathed coil springs in which longitudinal axes of the coil springs in adjacent segments are substantially parallel to one another, the adjacent segments being defined by adjacent rows of sheathed coil springs, the upper coils of the coil springs in adjacent segments lying in a substantially common plane and the lower coils of the coil springs in adjacent segments lying in a substantially common plane, means for joining adjacent segments of sheathed coil springs to one another, a second spring unit joined to and extending around a perimeter of the first spring unit, and a rigid frame extending around the second spring unit.

* * * * *